United States Patent [19]

Lamb

[11] Patent Number: 4,466,144

[45] Date of Patent: Aug. 21, 1984

[54] PULLEY ASSEMBLY FOR SWIMMING POOL COVER

[76] Inventor: Joe H. Lamb, 3500 Hillside La., Salt Lake City, Utah 84109

[21] Appl. No.: 464,757

[22] Filed: Feb. 7, 1983

[51] Int. Cl.[3] ..... E04H 3/19

[52] U.S. Cl. ..... 4/503; 4/502; 4/504

[58] Field of Search ..... 4/502, 498, 503, 504, 4/500

[56] References Cited

U.S. PATENT DOCUMENTS

| | | | |
|---|---|---|---|
| 3,050,743 | 8/1962 | Lamb | 4/502 |
| 3,051,234 | 8/1962 | Lamb | 160/272 |
| 3,747,132 | 7/1973 | Foster | 4/502 |
| 3,979,782 | 9/1976 | Lamb | 4/502 |
| 3,982,286 | 9/1976 | Foster | 4/502 |

*Primary Examiner*—Henry K. Artis

*Attorney, Agent, or Firm*—Workman, Nydegger & Jensen

[57] ABSTRACT

The present invention is directed to a novel pulley assembly used in connection with conventional swimming pool cover systems of the type utilizing draw cords carried by a dual-channel track. The pulley assembly is comprised of a pulley housing and a pulley such that the pulley housing is adapted for securement at the end of a section of track. In a preferred embodiment, the housing is provided with a tang-like projection adapted to be received in a slot in the track between the two channels so as to maintain the pulley system in proper alignment with respect to the track and the pulley is rotatably secured within a cylindrical cavity having sufficient clearance to permit free rotation of the pulley, but the clearance being less than the diameter of the draw cord so that the draw cord will remain engaged with the pulley. The housing is also preferably provided with a pair of bores or grooves, one of which defines a path for the draw cord to the pulley, and the second of which defines a path from the pulley, so that the path of the draw cord is a substantially continuous U-shape.

16 Claims, 11 Drawing Figures

PULLEY ASSEMBLY FOR SWIMMING POOL COVER

BACKGROUND

1. The Field of the Invention

The present invention generally relates to pulley systems used in connection with swimming pool covers of the type that utilize draw cords to extend and retract the cover. More particularly, the present invention is directed to a pulley assembly adapted for use with a track carrying such draw cords.

2. The Prior Art

It has been found very desirable to provide swimming pools with a removable cover which is placed over the pool when the pool is not in use. Use of such a cover greatly reduces evaporation loss and thus significantly decreases losses of thermal energy and chemicals. Use of a cover also reduces the need for filtration because the pool remains much cleaner.

Although various types of covers are available, the type of pool cover disclosed in U.S. Pat. No. 3,050,743 has met with great commercial acceptance. This type of cover typically includes a spool assembly installed at one end of the pool onto which one end of a flexible cover is secured in a manner such that the cover material may be extended and retracted along the length of a pool by rotating the spool.

The cover material is generally provided with beaded side edges formed by enclosing a draw cord within a marginal fold on each side of the cover. Each draw cord typically extends from the end of the cover, passes around a pulley at the end of the pool opposite the location of the spool assembly, and returns to a take up reel located near the spool assembly. An extruded track having a channel for guiding the beaded side edge and draw cord is generally secured to each side of the pool; the track also has a second channel for the returning end of the draw cord. In use, the reels are rotated so as to collect the draw cords thereon, thus causing the cover to be extended over the pool. For retraction, the spool is rotated in the opposite direction so as to rewind the cover.

In the past, one approach for mounting the pulley at the end of the pool opposite the spool assembly and reels has been to secure the pulley to the pool deck at a position beyond the end of the track. However, it is undesirable to utilize an exposed pulley because such an arrangement is unattractive and presents various safety hazards. Additionally, the use of an exposed pulley increases maintenance as it is necessary to keep the pulley clean and free of debris in order for it to function properly.

Because of these disadvantages, the conventional approach has been to mill out a portion of the track sufficiently so as to accommodate placement of a pulley. When this approach has been taken, the end of the track has typically been capped in order to seal off the exposed track channels. FIG. 1 illustrates such a prior art approach wherein a pulley 10 is secured near the end of a milled-out section 12 of a conventional track 14, with the exposed end of the track being fitted with an end cap 16. This is the approach disclosed in U.S. Pat. No. 3,051,232.

Placement of a pulley within a milled-out portion of the track has been acceptable from the standpoint of mechanical operation and this has been a standard practice for many years. However, this approach requires that a special milling step be performed during manufacture in order to prepare the extruded track so that the pulley may be attached thereto. In addition to the extra time involved to perform this milling step, the conventional approach also requires special tooling and skilled manpower. Additionally, it is not uncommon to remove too much material during the milling step. When such a mistake is made, or if the milling step is otherwise performed incorrectly, the end of the section of track must be cut off and discarded, and the milling step repeated. These factors all result in significantly greater costs attributable to the conventional placement of the pulley within a milled-out portion of the track.

Yet another disadvantage of the practice of securing a pulley within a milled-out portion of the extruded track is that the pulley is quite inaccessible once the track is secured in place to the pool deck since access to the pulley is only possible from the underside of the track. If for any reason the installer or a serviceman needs access to the pulley, it is necessary to detach the track from the pool deck sufficiently so that the track may be lifted, thereby giving access to the pulley. This significantly increases the cost of service and maintenance on an installed pool cover.

Yet another disadvantage of the conventional practice of placing a pulley within a milled-out portion of the track is that there is typically a large gap between the pulley and various surfaces of the track. This often results in disengagement of the draw cord from the pulley when slack is introduced or permitted to develop in the draw cord, which in turn frequently results in binding of the draw cord and rough operation of the pulley.

From the foregoing, it will be readily appreciated that it would be a significant advancement in the field of pool covers of the general type described above to provide for the installation of a pulley in connection with a section of extruded track that would avoid the need for milling out a portion of the track, and yet would allow use of an enclosed draw cord and pulley system. It would also be a significant advancement to provide for ready access to the pulley without the need to dismantle and remove the track assembly from its installed position. It would also be a significant advancement to provide for the installation of a pulley in a manner that would prevent disengagement of the draw cord so as to insure smooth operation and so as to prevent binding. The invention which is disclosed and claimed herein meets these longstanding needs.

BRIEF SUMMARY AND OBJECTS OF THE INVENTION

The present invention is directed to a novel pulley assembly for use in connection with conventional swimming pool cover systems of the type utilizing draw cords and track. Unlike systems developed heretofore wherein the draw cord passed around either an exposed pulley secured to the swimming pool deck, or a pulley secured to the underside of a milled-out portion of the track, the present invention provides a pulley assembly which, although enclosed, can be quickly and easily secured to the end portion of the track assembly without the need for any modification to the track.

This is accomplished by utilizing a pulley situated within a novel pulley housing which is adapted for securement at the end of the track. The configuration of the pulley housing is advantageously such that it appears to be a continuation of the track with which it is being used, thereby providing an attractive end-piece for the track. In a preferred embodiment of the present invention, the novel pulley assembly housing includes a projecting member adapted for engagement with a slot in the track so as to maintain the pulley assembly in proper alignment with respect to the track. Advantageously, the housing is also provided with a substantially cylindrical cavity within which the pulley is secured, with a gap between the pulley and the wall of the cavity less than the diameter of the draw cord so as to prevent disengagement of the draw cord from the pulley. It is presently preferred that the housing also be provided with a pair of bores aligned with the respective channels of the track so that the draw cord will follow a substantially continuous U-shaped path as it passes through the housing and around the pulley.

It is, therefore, an object of the present invention to provide an improved pulley system for swimming pool covers that may be utilized without the need for milling out sections of track.

Another object of the present invention is to provide an improved pulley system for swimming pool covers in which the enclosed pulley may be easily accessed without the need to remove large sections of track from securement to the pool deck.

Yet another object of the present invention is to provide an improved pulley system for swimming pool covers that is easier to install and repair and less expensive to manufacture than conventional systems.

Yet a further object of the present invention is to provide an improved pulley system for swimming pool covers that prevents disengagement of the draw cord from the pulley and operates very smoothly with no binding.

These and other objects and features of the present invention will become more fully apparent from the following description and appended claims taken in conjunction with the accompanying drawings.

DETAILED DESCRIPTION OF THE PREFERRED EMBODIMENTS

Figure 1:
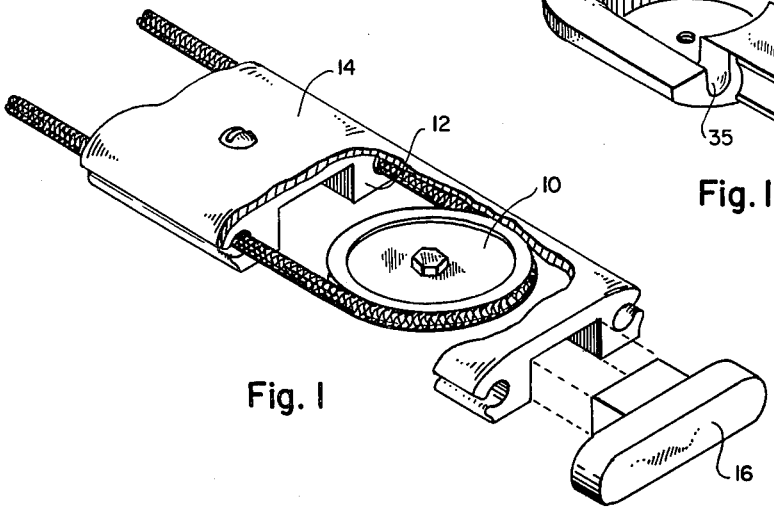
FIG. 1 is a fragmentary perspective view of a prior art pulley system wherein the pulley is secured within a milled-out portion of the track.

Referring now to the drawings, wherein like parts are referred to with like numerals throughout, FIGS. 2–5 illustrate one preferred embodiment of the invention. As can best be seen in FIGS. 3 and 4, the novel pulley system 20, includes a novel housing 22 which is provided with a substantially cylindrical cavity 23 sized so as to receive a pulley 24 without binding so that the pulley is capable of free rotation. Advantageously, the center of cavity 23 is drilled and tapped so as to receive a bolt 26, the bolt being used to rotatably secure pulley 24 within the housing.

Figure 2:
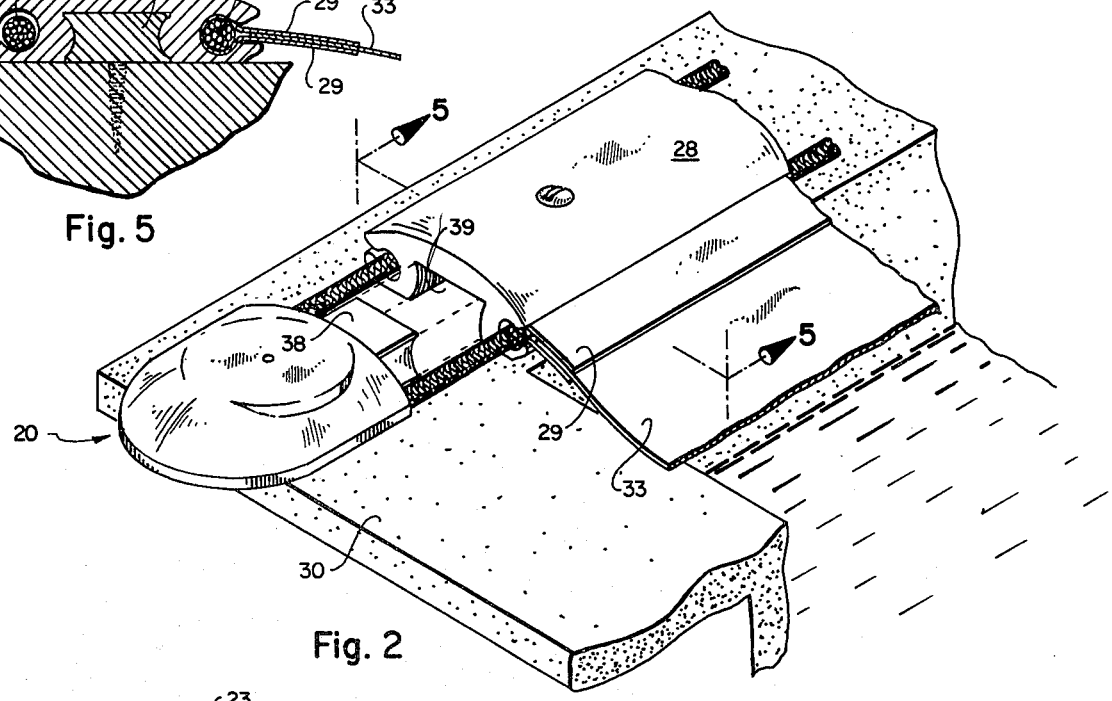
FIG. 2 is a fragmentary perspective view of a swimming pool provided with a swimming pool cover extended and retracted by means of a draw cord passing through a two-channel track fitted with a preferred embodiment of the pulley assembly of the present invention.

Unlike conventional approaches wherein a section of track material is milled out so as to accommodate placement of a pulley, the novel housing is adapted to be secured at the end of the track assembly without the need for any modification to the track. Additionally, housing 22 is preferably shaped so as to merge conveniently with the track, as shown in FIG. 2; not only does this configuration have aesthetic appeal, but it also serves to protectively enclose the pulley. This configuration renders unnecessary the requirement for a separate end cap of the type used in conventional installations. FIG. 2 illustrates how one presently preferred embodiment of the invention appears when installed in association with a track section 28 secured onto a pool deck 30, so that it carries a draw cord 32 and cover material 33 secured to the draw cord by means of a web member 29.

Figure 4:
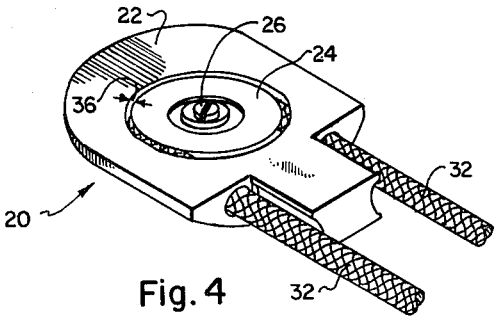
FIG. 4 is a perspective view similar to FIG. 3, but with the draw cord and pulley also being shown in relation to the pulley housing.

In order to facilitate placement of draw cord 32 around pulley 24, it is advantageous to provide a pair of bores 34 in the body of housing 22 which will readily accept the draw cord, but yet restrict the direction and area in which the draw cord can be moved. As best seen in FIG. 4, the pair of bores 34 and the groove in pulley 24 provide a substantially continuous U-shaped path for draw cord 32.

Figure 11:
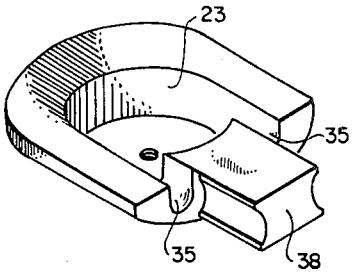
FIG. 11 is a perspective view of the underside of an alternative embodiment of a pulley housing similar to the pulley housing illustrated in FIG. 3, except that bores 34 have been replaced by grooves 35.
Figure 3:
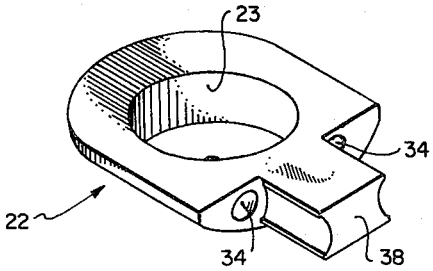
FIG. 3 is a perspective view of the underside of the pulley housing of an embodiment of the pulley assembly shown in FIG. 2.

An alternative embodiment of the pulley housing is illustrated in FIG. 11, where bores 34 of FIG. 3 are replaced by open grooves 35. Advantageously, a pulley housing having open grooves is easier and less expensive to manufacture because the housing may be manufactured in a ready-to-use condition by a single casting step. In contrast, when using bores 34, it is generally necessary to perform a drilling step after the housing has been cast. However, a housing having grooves is less able to withstand the significant stresses applied to pulley 24 during extension or retraction of the pool cover; hence, it is presently preferred to utilize the embodiment of the pulley housing having bores 34 rather than grooves 35. Nevertheless, if a sufficiently strong material were to be utilized in constructing the pulley housing, the use of grooves would be desirable.

It is advantageous to provide a clearance 36 between pulley 24 and the inner wall of housing 22 somewhat narrower than the diameter of the draw cord so that the draw cord will not become inadvertently disengaged from pully 24, and to effectively prevent any tendency toward binding. When utilizing the embodiment of pulley housing 22 incorporating bores 34, the pulley may be advantageously removed so as to facilitate the threading of the end of draw cord through the two bores. Alternatively, the pulley may be left in place and the end of draw cord 32 forced through one bore into cavity 23. Because cavity 23 is cylindrical, the draw cord will tend to follow the outline of the cavity as it is fed through the first bore, and will eventually exit through the second bore.

Once the pool cover incorporating the novel pulley assembly has been installed, the draw cord will generally be maintained under substantially constant tension by the use of take up reels or the like. This tension has been found sufficient to maintain pulley system 20 in place at the end of the track without the need for it to be actually affixed to the track or the pool deck.

Figure 5:
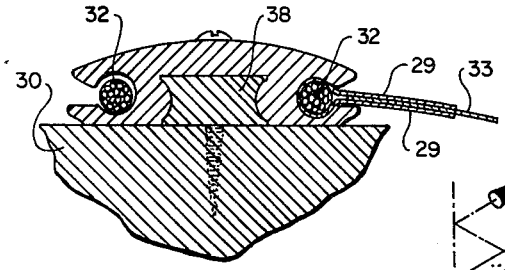
FIG. 5 is a cross-sectional view taken along line 5—5 of FIG. 2 and illustrates the manner in which the pulley assembly is aligned with the track.

However, it has been found that there is generally a need for some provision to maintain the alignment and positioning of the pulley system with respect to the track assembly. This is advantageously accomplished by providing a tang-like projecting member 38 that extends from the end of housing 22 and is configurated for engagement with a slot 39 in the track. Such a slot is generally used in conventional installations for alignment of various track pieces when several sections of track are to be interconnected. The manner in which projecting member 38 is coupled with the slot in the track is best illustrated in FIG. 5. Use of such a projecting member is very effective in maintaining proper alignment of the pulley assembly with respect to the track.

A significant advantage of using the novel pulley assembly is that it can be installed or removed for repair even though the track is securely fastened to the pool deck. By merely placing slack in the draw cord, it is a simple operation to disengage projecting member 38 from track 28 without the need for removing the track from the pool deck. This greatly simplifies installation and repair service on the pulley assembly, thereby providing cost savings to the consumer. The novel pulley assembly is also advantageous for reasons of safety. Not only is the pulley fully enclosed so as to prevent injury during extension or retraction of the pool cover, but the ease of installation and avoidance of a requirement for special milling steps eliminates common sources of injuries under the conventional approach.

The novel pulley assembly also has great cost advantages over the conventional approach, Thus, although the novel pulley assembly may be constructed from any convenient material, it is preferred that the housing be cast rather than prepared by some other process because of the ease and low cost of preparing the housing by this means. In order to maintain aesthetic appeal, the housing is preferably made of a material similar to that used in manufacturing the track, so that the housing will appear as a continuation and termination of the track.

Figure 6:
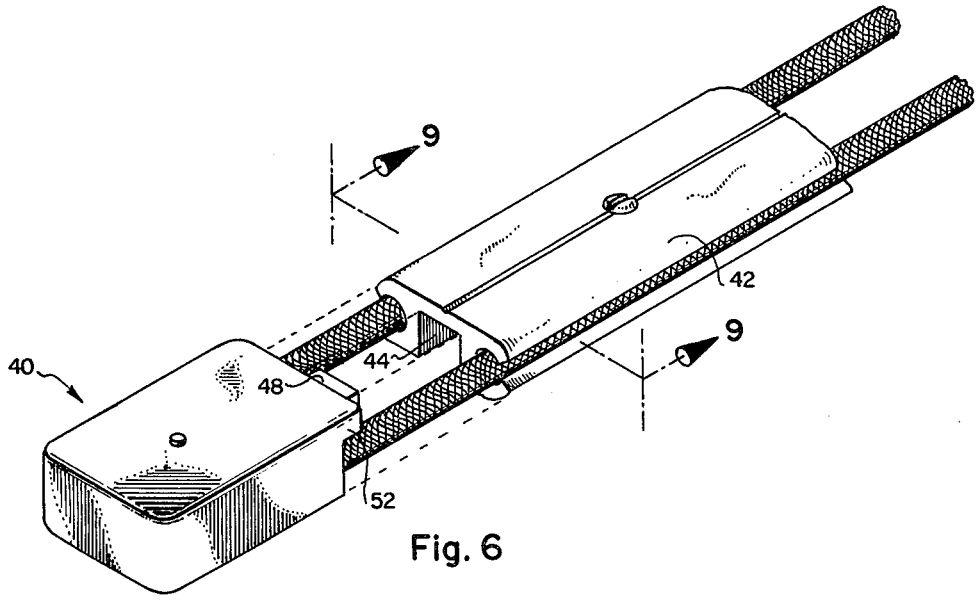
FIG. 6 is a perspective view of a second embodiment of the pulley assembly within the scope of the present invention shown in connection with an alternative track configuration.
Figure 10:
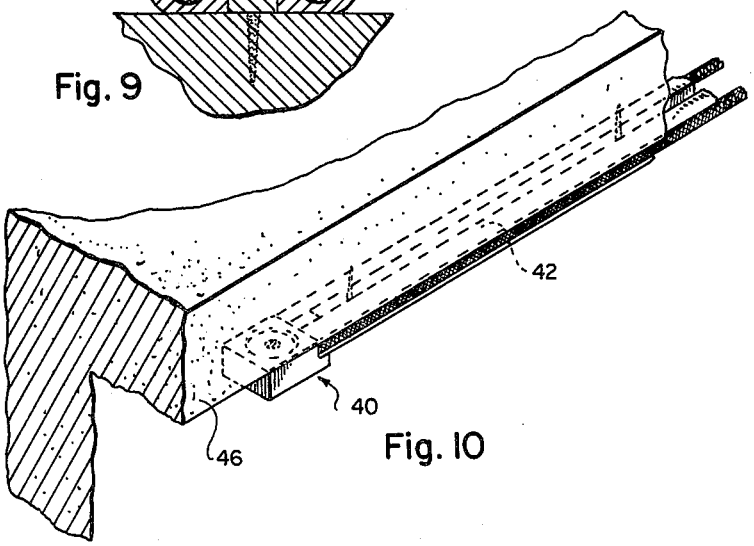
FIG. 10 is a fragmentary perspective view drawn to a smaller scale of the pulley assembly and track of FIG. 6 shown secured to the underside of an overhanging portion of the pool deck.

An alternative embodiment of the pulley assembly of the present invention is illustrated in FIGS. 6–10. FIG. 6 illustrates how pulley assembly 40 may be engaged with a section of track 42 having a slot 44. As may be seen, slot 44 is rectangular in shape rather than being specially shaped like the slot of track 28. FIG. 10 illustrates how track 42 may be installed underneath a projecting portion 46 of the pool deck in what is known as an "undertrack" configuration; this type of installation is often preferred for use in connection with rectangular pools because the track is hidden from view, thereby being more aesthetically appealing and eliminating the track on the upper edge of the pool where swimmers often walk or sit. It will be appreciated that the present invention is particularly useful in connection with an undertrack installation because of the added difficulty of gaining access for repairs to a conventional pulley system in this type of installation.

Figure 7:
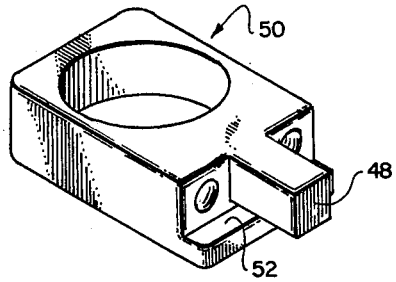
FIG. 7 is a perspective view of the underside of the pulley housing of the embodiment of the invention shown in FIG. 6.
Figure 8:
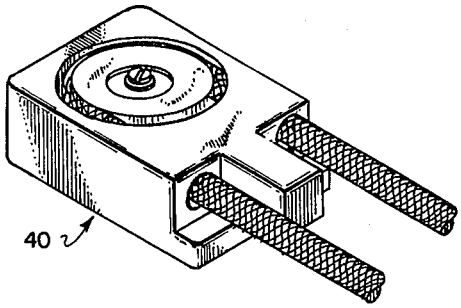
FIG. 8 is a perspective view similar to FIG. 7, but with the pulley and draw cord also being shown in relation to the pulley housing.
Figure 9:
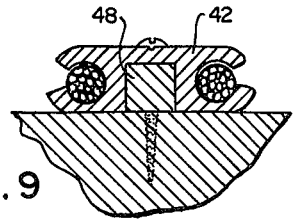
FIG. 9 is a cross-sectional view taken along line 9—9 of FIG. 6, and illustrates the manner in which the second embodiment is aligned with the track.

In a manner similar to that of the first-described embodiment of the novel pulley system, FIGS. 7 and 8 illustrate that a projecting member 48 of housing 50 is adapted for engagement with slot 44 of the track assembly. However, while use of a rectangular projecting member 48 is adequate to maintain the proper orientation of pulley assembly 40 with respect to side-to-side motion, it has been found that such a projecting member is not generally able to adequately maintain the proper orientation of the pulley assembly with respect to movement up or down. Thus, in the installation shown in FIG. 10, there is often a tendency for the pulley assembly to be pulled upward or downward if no provision is made to restrict that movement. Either upward or downward movement decreases the ability of the pulley to rotate freely, thus increasing the strain on the motor used for extending and retracting the pool cover.

This tendency to move upward or downward may be overcome by providing a ledge 52 spaced apart from projecting member 48 at a distance sufficient so that the ledge rests against the surface of the track, while the projecting member rests against the slot. It will be appreciated that ledge 52 may be of varying length, width, or shape—the only requirement being that it have sufficient length and width and fit closely enough against the track to serve the function of maintaining the pulley assembly in proper orientation with respect to the track.

As may be further seen in FIGS. 6 and 10, no attempt need be made to conform the appearance of the pulley assembly to that of the track when using an "undertrack" installation, since both the track and pulley assembly will be hidden from view.

From the foregoing, it will be apparent that the need to specially prepare the track to receive a pulley, as is required in conventional systems, has been completely eliminated. Furthermore, a worn out pulley may be easily removed or replaced without the need to detach any portion of the track assembly from the pool deck, making installation and maintenance much simpler and significantly less costly than when utilizing the conventional approach. In addition, use of a narrow clearance between the pulley and the wall of the cavity and use of bores 34 or grooves 35 provide a substantially enclosed U-shaped path for the draw cord through the pulley assembly. This configuration is extremely beneficial for preventing disengagement of the draw cord from the pulley, for avoiding problems of binding, and for insuring generally smooth and trouble-free operation.

It will also be appreciated that the overall shape and appearance of the pulley assembly may be modified greatly and still remain within the scope of the present invention. Additionally, the novel pulley assembly may be used in connection with track lacking slots into which a tang-like projecting member may be inserted, although provision must then be made to maintain the pulley assembly in proper alignment with the track, such as by providing projections that extend into the two channels. Another alternative would be to reverse bolt 26 so that it passes through the housing and the pulley and then into the deck, thereby securing the pulley assembly to the deck at a location adjacent the end of the track.

Thus, although the apparatus of the present invention has been shown and described in reference to two particular embodiments, it is to be understood that the apparatus of the invention may also be embodied in other specific forms without parting from its spirit or essential characteristics. The desired embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A swimming pool cover system comprising:

a cover having securement means along the longitudinal edges thereof, said cover further having draw cords attached thereto for use in extending the cover over a swimming pool;

a pair of tracks, one of said pair of tracks being secured on each side of the swimming pool, each track having a first channel adapted to receive the securement means of the cover and one portion of the draw cord in sliding engagement therein, and a second channel adapted to receive another portion of the draw cord, said track also having a slot situated between the first and second channels; and a pulley assembly secured at the end of each track, said pulley assembly including a housing and a pulley around which the draw cord travels as the draw cord passes from the end of the first channel and before entering the second channel, said housing having a projecting member adapted for engagement with the slot of the track so as to maintain the pulley assembly in proper alignment with respect to the track.

2. A swimming pool cover system as defined in claim 1 wherein the pulley assembly housing has a substantially cylindrical cavity within which is secured the pulley, said cavity being sized so as to allow sufficient clearance between the pulley and wall of the cavity to permit rotation of the pulley, but said clearance being less than the diameter of the draw cord so that the draw cord will be maintained in engagement with said pulley.

3. A swimming pool cover system as defined in claim 2, wherein the pulley assembly housing is further provided with a pair of bores, one of said bores being adapted to permit entry of the draw cord from the first channel of the track and into the interior of the pulley assembly housing so that said draw cord may pass around the pulley, and the second bore permitting exit of the draw cord from the pulley assembly housing and into the second channel of the track.

4. A swimming pool cover system as defined in claim 2, wherein the pulley assembly housing is further provided with a pair of grooves, one of said grooves being adapted to permit entry of the draw cord from the first channel of the track and into the interior of the pulley assembly housing so that said draw cord may pass around the pulley, and the second groove permitting exit of the draw cord from the pulley assembly housing and into the second channel of the track.

5. A swimming pool cover system as defined in claim 1, wherein the pulley assembly housing is further provided with a pair of bores, one of said bores being adapted to permit entry of the draw cord from the first channel of the track and into the interior of the pulley assembly housing so that said draw cord may pass around the pulley, and the second bore permitting exit of the draw cord from the pulley assembly housing and into the second channel of the track.

6. A swimming pool cover system as defined in claim 1, wherein the pulley assembly housing is further provided with a pair of grooves, one of said grooves being adapted to permit entry of the draw cord from the first channel of the track and into the interior of the pulley assembly housing so that said draw cord may pass around the pulley, and the second groove permitting exit of the draw cord from the pulley assembly housing and into the second channel of the track.

7. A swimming pool cover system as defined in claim 1 wherein the pulley assembly housing further comprises a ledge member spaced apart from the projecting member, the combination of the projecting member and ledge member being adapted to maintain the pulley assembly in proper alignment with respect to the track.

8. A swimming pool cover system as defined in claim 3 wherein the pulley assembly housing further comprises a ledge member spaced apart from the projecting member, the combination of the projecting member and ledge member being adapted to maintain the pulley assembly in proper alignment with respect to the track.

9. A swimming pool cover system as defined in claim 4 wherein the pulley assembly housing further comprises a ledge member spaced apart from the projecting member, the combination of the projecting member and ledge member being adapted to maintain the pulley assembly in proper alignment with respect to the track.

10. A swimming pool cover system as defined in claim 1 wherein the pulley assembly housing serves as an end-piece to the track.

11. A swimming pool cover system as defined in claim 1 wherein the pulley assembly housing is cast.

12. A swimming pool cover system comprising:

a cover having longitudinal edges thickened as slides, said cover having draw cords attached thereto for use in extending the cover over a swimming pool;

two tracks, said tracks being secured on opposite sides of the swimming pool, each said track having a first channel adapted to slidingly receive the thickened edge of the cover and a portion of the draw cord, a second channel adapted to receive another portion of the draw cord, and a slot on the underside of the track between said first and second channels; and a pulley assembly comprised of a housing having a projecting member adapted to be receivingly engaged by said slot in the track so as to maintain the pulley assembly in proper alignment with said track, said housing also having a pair of bores and a substantially cylindrical cavity within which is rotatably secured a pulley, one of said bores communicating with the first channel of the track, and the other bore communicating with the second channel of the track, said bores also communicating with the cavity so as to form a substantially continuous U-shaped path for the draw cord passing from the first channel to the second channel of the track.

13. A swimming pool cover system as defined in claim 12 wherein the pulley assembly housing further comprises a ledge member spaced apart from the projecting member, the combination of the projecting member and ledge member being adapted to maintain the pulley assembly in proper alignment with respect to the track.

14. A swimming pool cover system as defined in claim 12 wherein the pulley assembly housing serves as an end-piece to the track.

15. A swimming pool cover system as defined in claim 12 wherein the pulley assembly housing is cast.

16. A swimming pool cover system as defined in claim 12 wherein the bores comprise open grooves.

* * * * *